United States Patent [19]

Saitoh et al.

[11] 4,352,076

[45] Sep. 28, 1982

[54] BAND PASS FILTERS

[75] Inventors: Takeshi Saitoh, Yokohama; Hiroshi Hatashita, Tokyo; Toshio Nagashima; Susumu Yamamoto, both of Yokohama, all of Japan

[73] Assignee: Hitachi, Ltd., Tokyo, Japan

[21] Appl. No.: 186,738

[22] Filed: Sep. 12, 1980

[30] Foreign Application Priority Data

Sep. 19, 1979 [JP] Japan ..... 54-119404

[51] Int. Cl.[3] ..... H01P 1/203; H01P 1/212

[52] U.S. Cl. ..... 333/204; 333/246

[58] Field of Search ..... 333/202–205, 333/110, 134, 246

[56] References Cited

U.S. PATENT DOCUMENTS 3,796,970 3/1974 Snell, Jr. ..... 333/134

FOREIGN PATENT DOCUMENTS 53-41153 4/1978 Japan .
53-21632 7/1978 Japan .
54-71940 5/1979 Japan .

*Primary Examiner*—Marvin L. Nussbaum
*Attorney, Agent, or Firm*—Kenyon & Kenyon

[57] ABSTRACT

In a band pass filter of micro strip line structure, an input conductor, an output conductor, a first open end conductor and a second open end conductor are provided. The first and the second open end conductors are located opposite to the input and the output conductors forming narrow gaps between said open end conductors and said input and output conductors. The mutual inductance between the first and the second open end conductors is adjusted by selecting the width of the gap between the first and the second open end conductors.

5 Claims, 10 Drawing Figures

BAND PASS FILTERS

TECHNICAL FIELD

The present invention relates to a band pass filter and, more particularly, a band pass filter constituted by a micro strip line structure. The band pass filter of the present invention is used, for example, in a television tuning circuit.

BACKGROUND ART

A band pass filter constituted by a micro strip line structure is illustrated in FIG. 1 and a cross-sectional view of that filter is illustrated in FIG. 2. The band pass filter of FIG. 1 comprises a dielectric plate 1 made of, for example, polyolefines, teflon or ceramics, an input conductor 21, an output conductor 22, ring conductors (closed end conductors) 51 and 52, a coupling conductor 6 and a ground conductor 7. The input conductor 21, the output conductor 22, the ring conductors 51, 52 and a coupling conductor 6 are made of, for example, copper and are formed by an etching process on the top surface of the dielectric plate 1. The ground conductor 7 is made of, for example, copper and is attached on the bottom surface of the dielectric plate 1.

A signal supplied to the band pass filter of FIG. 1 is transmitted through the input conductor 21, the ring conductor 51, the coupling conductor 6, the ring conductor 52 and the output conductor 22. The frequency selection is carried out due to the resonance characteristics of the ring conductors 51 and 52. A band pass filtering characteristic of the stagger type is obtained in the band pass filter of FIG. 1, in which a loss characteristic on the order of 5 to 6 dB at 3 GHz and a 3 dB bandwidth characteristic of approximately 12 to 15 MHz are attained.

The close proximity of the input conductor 21 and the output conductor 22, between which a narrow gap 3 is formed, gives the band pass filter of FIG. 1 a trap characteristic in the frequency ranges just above and just below the pass band.

The attenuation characteristics of the band pass filter of FIG. 1 is illustrated in FIG. 3. In FIG. 3, the abscissa represents the frequency f in MHz and the ordinate represents the attenuation ATT in dB. The frequency $f_0$ is the central value, for example 3 GHz, of the pass band frequencies. Trap regions are formed corresponding to the frequencies $f_1$ and $f_2$. The frequencies $f_1$ and $f_2$ are symmetrical with respect to the frequency $f_0$. These trap regions are formed due to the close location of the input conductor 21 and the output conductor 22. The narrower the gap 3 between the input conductor 21 and the output conductor 22, the less the difference between trap frequencies $f_1$, $f_2$ and the central pass band frequency $f_0$. Thus, in the band pass filter of FIG. 1, a narrow band pass characteristic with a single peak stagger resonance feature is obtained.

However, the band pass filter of FIG. 1 is disadvantageous because of the facts that: the pattern of the ring conductors 51, 52 is relatively large and complicated; the existence of the coupling conductor 6 is necessary; the adjustment of the coupling between the ring conductors 51, 52 and the coupling conductor 6 is necessary, and; accordingly, the size of the band pass filter is caused to be large and the design of the structure of the band pass filter tends to become complicated.

The present invention is directed to prevent the above described disadvantages encountered in the band pass filter described above. This band pass filter is described in Japanese Utility Model application No. 54-10382, assigned to the same assignee of the present invention, this application having been laid open in Japan on Aug. 9, 1980.

An example of a prior art band pass filter is disclosed in the following publication.

(1) Japanese Utility Model Application Laid-open No. 54-71940

SUMMARY OF THE INVENTION

The main object of the present invention is to provide a band pass filter in which conductors having a relatively simple shape are used, and a simple structure of the coupling between conductors is used, and accordingly, a relatively simple structure of the band pass filter is obtained.

According to the present invention there is provided a band pass filter consisting of the micro strip line structure, characterized in that a first open end conductor and a second open end conductor are arranged in parallel, the length of each of said first and second open and conductors being approximately equal to one half of the wave length of the band pass frequency, and an input conductor and an output conductor are arranged opposite to the same side ends of said first and second open end conductors, respectively, forming narrow gaps between said first and second open end conductors, and said input and output conductors, respectively.

DESCRIPTION OF THE PREFERRED EMBODIMENTS

Figure 1:
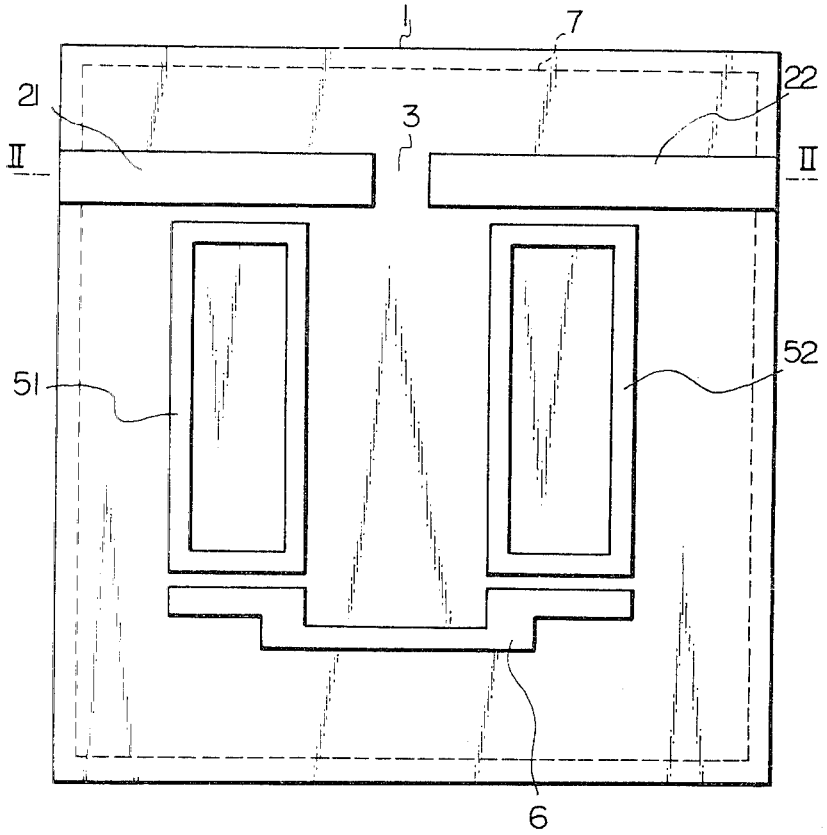
FIG. 1 is a plan view of a band pass filter.
Figure 2:
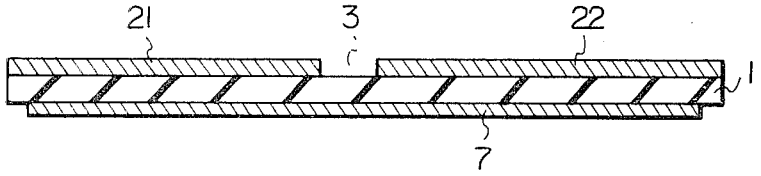
FIG. 2 is a cross-sectional view taken along the line II—II of FIG. 1.
Figure 3:
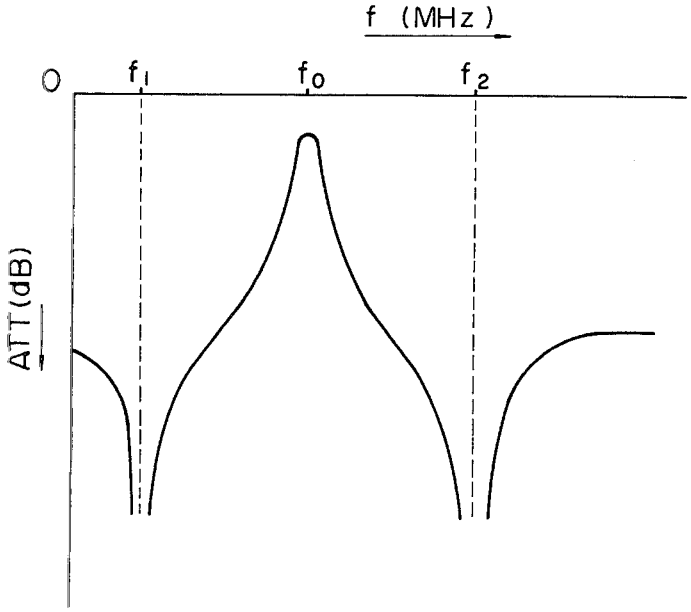
FIG. 3 illustrates the attenuation characteristic of the band pass filter of FIG. 1.
Figure 4:
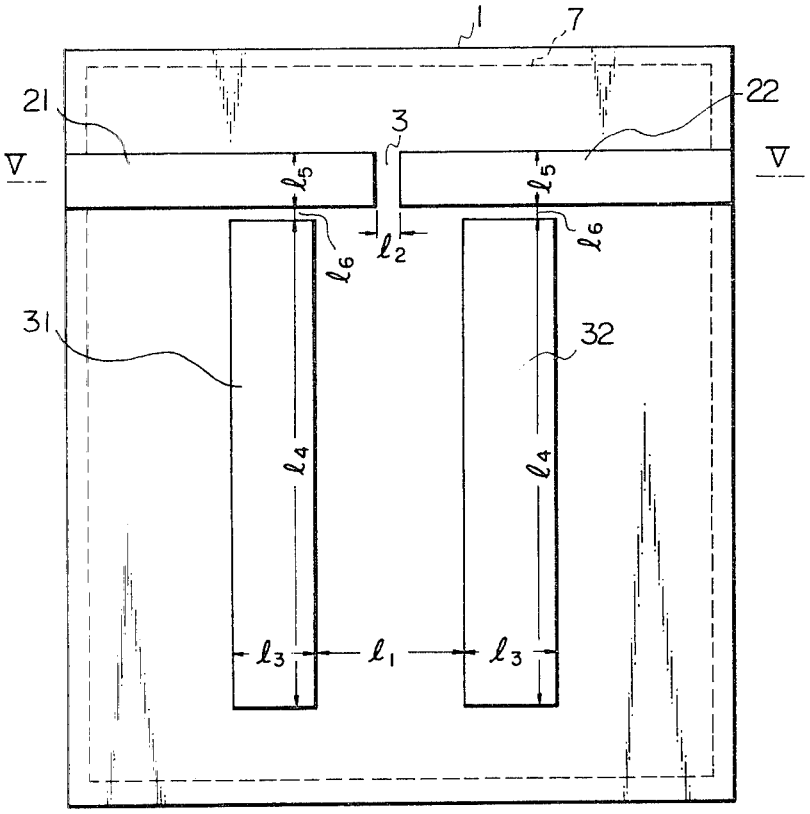
FIG. 4 is a plan view of a band pass filter as an embodiment of the present invention.
Figure 5:
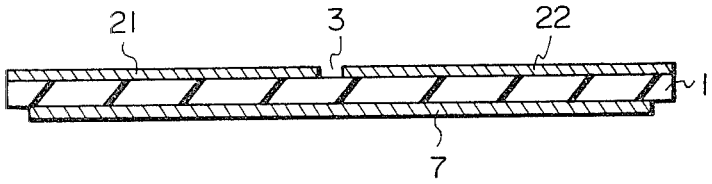
FIG. 5 is a cross-sectional view taken along the line V—V of FIG. 4.

A band pass filter according to an embodiment of the present invention is illustrated in FIG. 4. The cross-section of the band pass filter of FIG. 4 is illustrated in FIG. 5. The band pass filter of FIG. 4 comprises a dielectric plate 1 made of, for example, polyolefines, teflon or ceramics, an input conductor 21, an output conductor 22, open end conductors 31 and 32 and a ground conductor 7. The input conductor 21, the output conductor 22, and open end conductors 31 and 32 are made of, for example, copper, and are formed by an etching process on the top surface of the dielectric plate 1. The ground conductor 7 is made of, for example, copper, and is attached to the bottom surface of the dielectric plate 1.

The open end conductors 31 and 32 are arranged in parallel keeping a distance $l_1$ between them. The input conductor 21 and the output conductor 22 are closely located keeping a gap 3 of a width $l_2$. The length and the width of the open end conductor 31 are $l_4$ and $l_3$, respectively. The length and width of the open end conductor 32 are $l_4$ and $l_3$, respectively. The width of each of the input conductor 21 and the output conductor 22 is $l_5$. The width of a gap between the input conductor 21 or the output conductor 22 and the open end conductor 31 or the output conductor 32 is $l_6$. The length $l_4$ of the open end conductor 31, 32 is approximately equal to one half of the wave-length of the band pass frequency.

A signal supplied to the band pass filter of FIG. 4 is transmitted from the input line 21 to the open end conductor 31, then, from the open end conductor 31 to the open end conductor 32 through the mutual inductance coupling between the conductors 31 and 32, and then, from the open end conductor 32 to the output conductor 22. The value of the mutual inductance between the conductors 31 and 32 is determined by the distance $l_1$ and can be varied by varying the distance $l_1$.

Figure 6A:
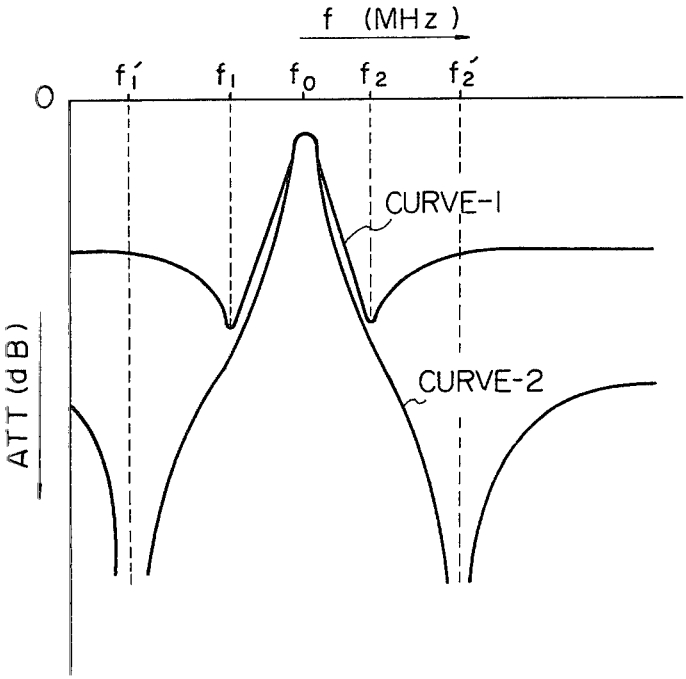
FIGS. 6A and 6B illustrate the attenuation characteristic of the band pass filter of FIG. 4.

The attenuation characteristics of the band pass filter of FIG. 4 is illustrated in FIG. 6A. In FIG. 6A, the abscissa represents the frequency f in MHz and the ordinate represents the attenuation ATT in dB. The Curve-1 indicates the characteristic in the case where the gap width $l_2$ is small, and the Curve-2 indicates the characteristic in the case where the gap width $l_2$ is large. Trap regions are formed corresponding to the frequencies $f_1$, $f'_1$, $f_2$ and $f'_2$. The frequencies $f_1$, $f'_1$, $f_2$ and $f'_2$ are symmetrical with respect to the central band pass frequency $f_0$. These trap regions are formed due to the close location of the input conductor 21 and the output conductor 22. Thus, the attenuation in the block band frequency regions can be increased by selecting the width $l_2$ of the gap 3.

Figure 6B:
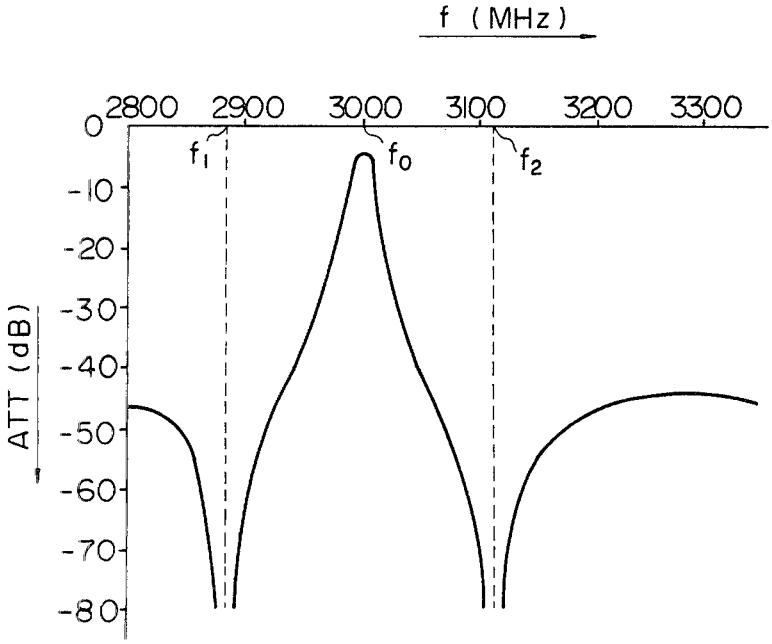

The result of a experiment regarding the band pass filter of FIG. 4 is illustrated in FIG. 6B. The particulars of the specimen used are as follows.

(1) Dielectric Plate 1:
Polyolefines, Thickness: 0.8 mm,
Dielectric Constant: 2.3,
tan $\delta$: $2\times10^{-4}$
(2) Sizes and Arrangements of Conductors:
$l_1=9$ mm, $l_2=2$ mm, $l_3=5$ mm, $l_4=34$ mm,
$l_5=2.5$ mm, $l_6=0.1$ mm
(3) Impedance of the Measurement System:
50 Ω

In FIG. 6B, it can be seen that the central band pass frequency $f_0$ is 3 GHz, the attenuation at the frequency $f_0$ is −4.5 dB, the width of the pass band within a 3 dB attenuation is 15 MHz, the upper trap frequency $f_2$ is 3.114 GHz and the width of the trap band over −75 dB is ±5 MHz. The characteristic illustrated in FIG 6B is useful for a device for eliminating image frequency signals in a television system.

Figure 7:
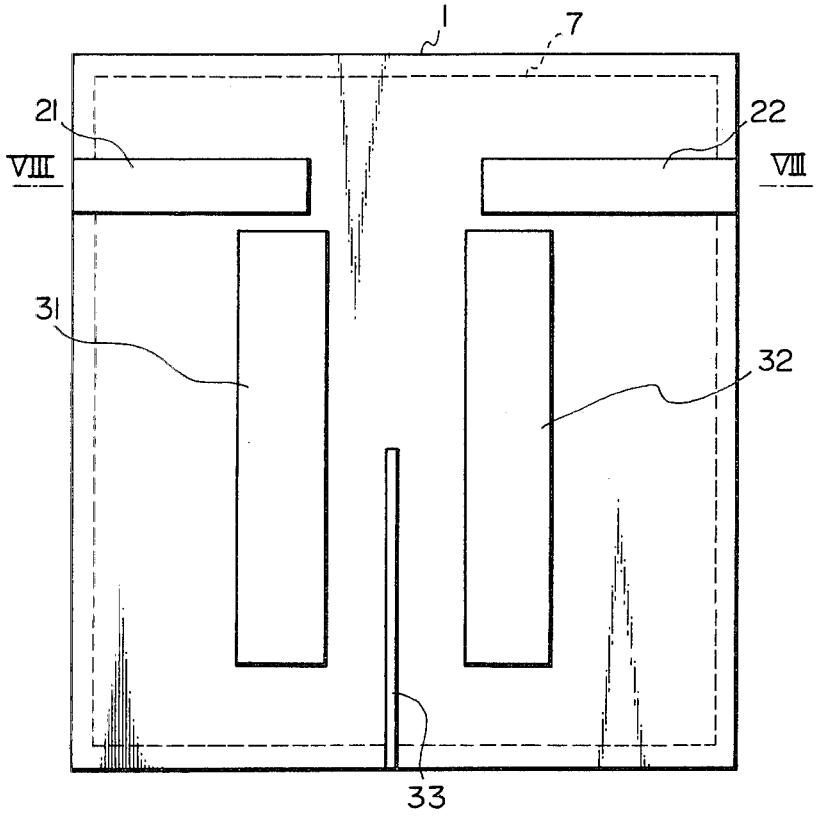
FIG. 7 is a plan view of a band pass filter as another embodiment of the present invention.
Figure 8:
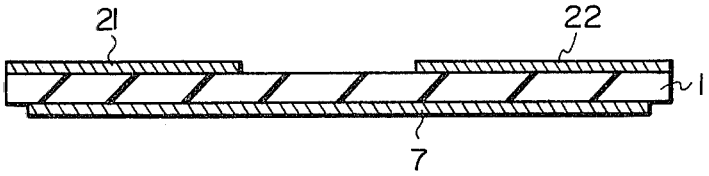
FIG. 8 is a cross-sectional view taken along the line VIII–VIII of FIG. 7.

A band pass filter according to another embodiment of the present invention is illustrated in FIG. 7. The cross-section of the band pass filter of FIG. 7 is illustrated in FIG. 8. The band pass filter of FIG. 7 comprises a dielectric plate 1, an input conductor 21, an output conductor 22, open end conductors 31 and 32, and a ground conductor 7. It is possible to provide a third open end conductor 33 between said open end conductors 31 and 32, and connected with the ground conductor 7. The input conductor 21, the output conductor 22, and open end conductors 31, 32 and 33 are made of, for example, copper, and are formed by etching process on the top surface of the dielectric plate 1. The ground conductor 7 is made of, for example, copper, and is attached to the bottom surface of the dielectric plate 1.

A signal supplied to the band pass filter of FIG. 7 is transmitted from the input conductor 21 to the open end conductor 31, then, from the open end conductor 31 to the open end conductor 32 through the mutual inductance coupling between the conductors 31 and 32, and then, from the open end conductor 32 to the output conductor 22. The value of the mutual inductance between the conductors is determined by the distance between the conductors 31 and 32, and if the third open end conductor 33 exists, the length of the third open end conductor 33.

Figure 9:
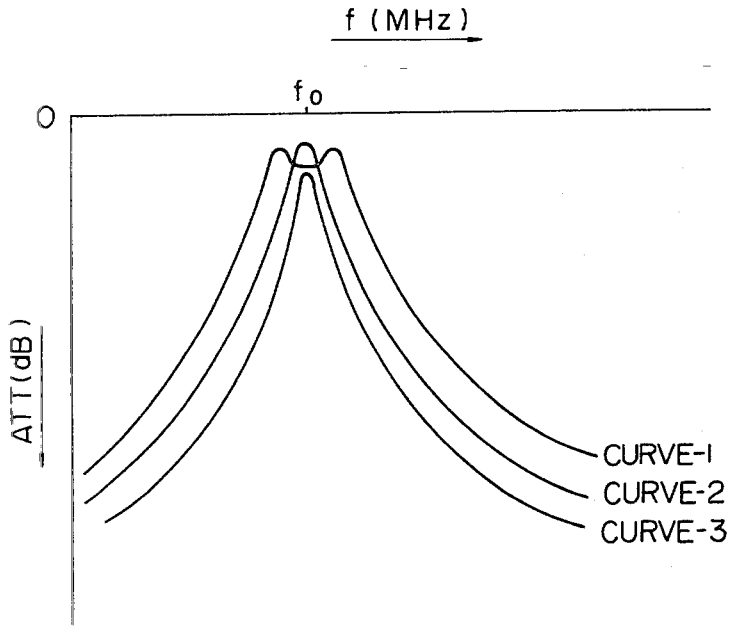
FIG. 9 illustrates the attenuation characteristic of the band pass filter of FIG. 7.

The attenuation characteristic of the band pass filter of FIG. 7 is illustrated in FIG. 9. The Curve-1 of double peak form represents the attenuation characteristic in the case where the mutual inductance between the conductors 31 and 32 is large. The Curve-3 of single peak form represents the attenuation characteristic in the case where the mutual inductance between the conductors 31 and 32 is small. Attenuation in the pass band is greater in Curve-3 than in Curve-1. The Curve-2 of the single peak form represents the most desirable attenuation characteristic in the case where the mutual inductance between the conductors 31 and 32 attains the critical value. Attenuation in the pass band is minimum in Curve-2.

We claim:

1. A band pass filter consisting of a micro strip line structure, characterized in that a first open end conductor and a second open end conductor are arranged in parallel, the length of each of said first and second open end conductors being approximately equal to one half of the wave length of the band pass frequency, and an input conductor and an output conductor are arranged opposite to the same side ends of said first and second open end conductors, respectively, forming narrow gaps between said first and second open end conductors, and said input and output conductors, respectively.

2. A band pass filter as defined in claim 1, wherein said input and output conductors are located in close proximity forming a gap therebetween the width of which is smaller than the width of the gap between said first and second open end conductors.

3. A band pass filter as defined in claim 1 or 2, wherein a third open end conductor is arranged between said first and second open end conductors.

4. A band pass filter as defined in claim 3, wherein each of said first and second open end conductors has a rectangular shape.

5. A band pass filter as defined in claim 1 or 2, wherein each of said first and second open end conductors has a rectangular shape.

* * * * *